US005380208A

United States Patent [19]

Ying

[11] Patent Number: 5,380,208

[45] Date of Patent: Jan. 10, 1995

[54] LAMP SOCKET MOUNTING DEVICE

[76] Inventor: Lu C. Ying, No. 531, Sec. 4, Chung Hwa Rd., Hsin Chu City, Taiwan, Prov. of China

[21] Appl. No.: 176,888

[22] Filed: Jan. 3, 1994

[51] Int. Cl.[6] ..... H01R 13/32

[52] U.S. Cl. ..... 439/558

[58] Field of Search ..... 439/557, 558

[56] References Cited

U.S. PATENT DOCUMENTS 2,211,739 8/1940 Churchill ..... 439/558
3,476,928 11/1969 Greasley ..... 439/558 X
3,614,713 10/1971 Heath ..... 439/558

FOREIGN PATENT DOCUMENTS 2043369 10/1980 United Kingdom ..... 439/557

*Primary Examiner*—William Briggs

[57] ABSTRACT

A lamp socket mounting device includes a butterfly clamping plate mounted around a lamp socket to hold it in the socket mounting hole of a socket holder, wherein the butterfly clamping plate consists of a loop-like base frame portion mounted around the lamp socket, two curved, symmetrical upper stop frame portions bilaterally extended downwards from the loop-like base frame portion, two half-round bottom stop frame portions stopped against the socket holder at the bottom, and two neck portions respectively connected between the upper stop frame portions and the bottom stop frame portions and stopped against the periphery of the socket mounting hole, the upper stop frame portions having a respective bottom end terminated to a respective clamping edge stopped against the socket holder at the top.

1 Claim, 5 Drawing Sheets

LAMP SOCKET MOUNTING DEVICE

BACKGROUND OF THE INVENTION

The present invention relates to a lamp socket mounting device which uses a butterfly clamping plate to fasten a lamp socket to the socket holder of a lighting fixture.

Referring to FIGS. 1, 1A and 1B, wherein showing a conventional lamp socket mounting device mounted on a socket holder where shown in FIG. 2.

The socket mounting hole 31 of the socket holder 30 of a lighting fixture or decorative light set is made approximately equal to the outer diameter of the conventional lamp socket 26 to be installed. The conventional lamp socket 26 was inserted into the socket mounting hole 31 of the socket holder 30 and fixed on the socket holder 30 by coupling the neck portion 242 of the clamping plate 20' to the groove 311 of the socket holder 30. During the mounting procedure, the lamp socket may be forced by an error to drop inside the socket holder.

SUMMARY OF THE INVENTION

The present invention has been accomplished under the aforesaid circumstances. It is therefore one object of the present invention to provide a lamp socket mounting device which prohibits the lamp socket from dropping inside the socket holder during the installation procedure. It is another object of the present invention to provide a lamp socket mounting device which can be conveniently installed. It is still another object of the present invention to provide a lamp socket mounting device which is inexpensive to manufacture. According to the preferred embodiment of the present invention, the lamp socket mounting device comprises a butterfly clamping plate mounted around a lamp socket to hold it in the socket mounting hole of a socket holder, wherein the butterfly clamping plate comprises a loop-like base frame portion mounted around the lamp socket, two curved, symmetrical upper stop frame portions bilaterally extended downwards from the loop-like base frame portion, two half-round bottom stop frame portions stopped against the socket holder at the bottom, and two neck portions respectively connected between the upper stop frame portions and the bottom stop frame portions and stopped against the periphery of the socket mounting hole, the upper stop frame portions having a respective bottom end terminated to a respective clamping edge stopped against the socket holder at the top. The length of the clamping edge of either upper stop frame portion is longer than the diameter of the socket mounting hole on the socket holder, therefore the butterfly clamping plate, namely, the lamp socket will not drop inside the socket holder during the mounting procedure.

DETAILED DESCRIPTION OF THE PREFERRED EMBODIMENT

Figure 1:
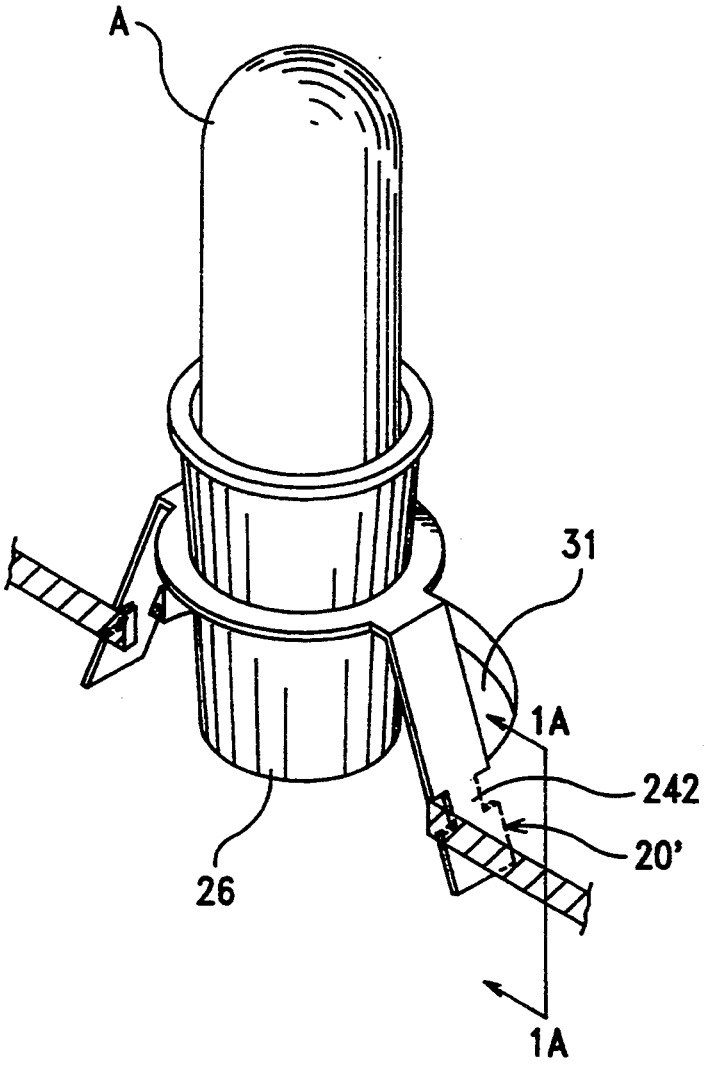
FIG. 1 (PRIOR ART)
FIG. 1 is a perspective view showing a conventional lamp socket mounting device mounted on a socket holder.
Figure 1A:
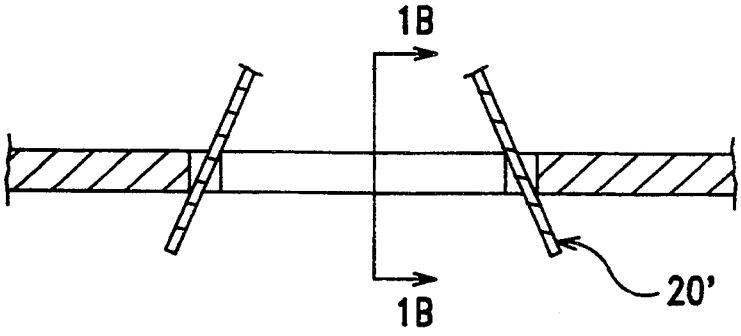
FIG. 1A (PRIOR ART)
FIGS. 1A and 1B are sectional views showing the conventional lamp socket mounting device mounted on a socket holder.
Figure 1B:
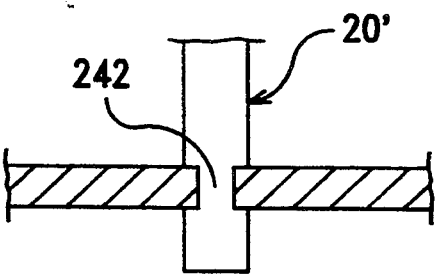
FIG. 1B (PRIOR ART)
Figure 2:
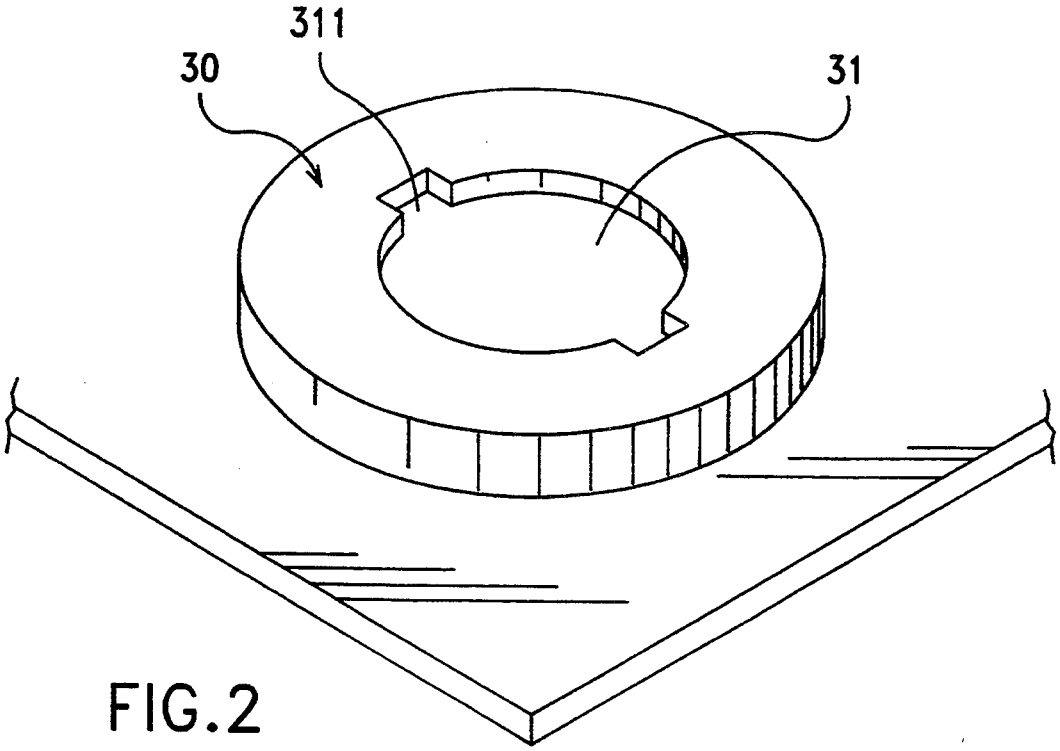
FIG. 2 is a perspective view showing a socket holder for mounting the lamp socket mounting device.
Figure 3:
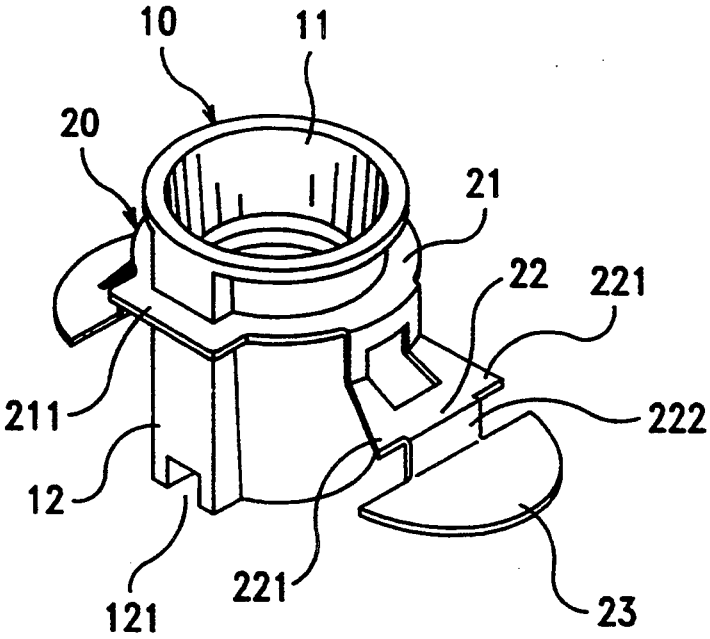
FIG. 3 is a perspective view of a lamp socket mounting device according to the preferred embodiment of the present invention.

Referring to FIG. 3, a lamp socket mounting device in accordance with the present invention is generally comprised of a lamp socket 10 and a butterfly clamping plate 20. The lamp socket 10 is made of cylindrical shape gradually smaller toward the bottom, having a trapezoidal block 12 raised from the outside wall and extended from the annular top flange 11 to the bottom edge therefor. A rectangular groove 121 is made through the bottom of the trapezoidal block 12 for inserting an electric wire. The butterfly clamping plate 20 comprises a loop-like base frame portion 21 mounted around the lamp socket 10, two curved, symmetrical upper stop frame portions 22 bilaterally extended downwards from the loop-like base frame portion 21, two half-round bottom stop frame portions 23, and two neck portion of 222 respectively connected between the upper stop frame portions 22 and the bottom stop frame portions 23. The upper stop frame portions 22 have a respective bottom end terminated to a respective clamping edge 221. The loop-like base frame 21 comprises a rectangular portion 211 fitted over the trapezoidal block 12, and therefore the butterfly clamping plate 20 is prohibited from rotary motion on the lamp socket 10. Because the lamp socket 10 is made gradually smaller toward the bottom, the loop-like base frame 21 of the butterfly clamping plate 20 can be conveniently fastened to the lamp socket 10 from the bottom.

Figure 4:
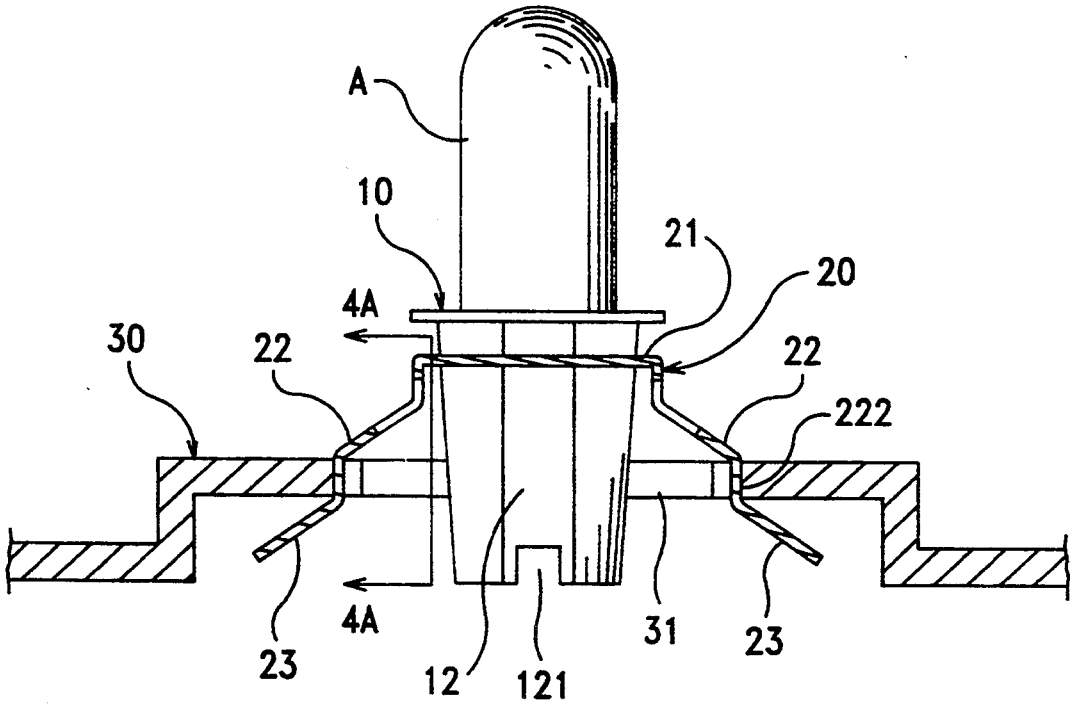
FIGS. 4 and 4A are sectional views showing the lamp socket mounting device mounted on a socket holder.
Figure 4A:
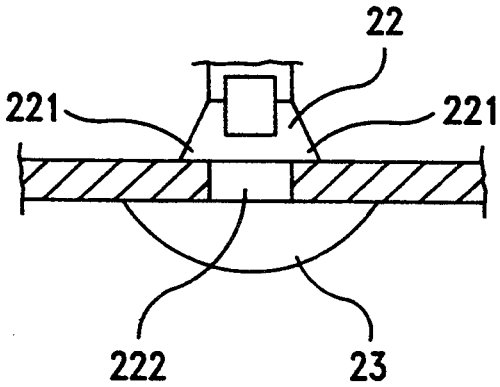
Figure 5:
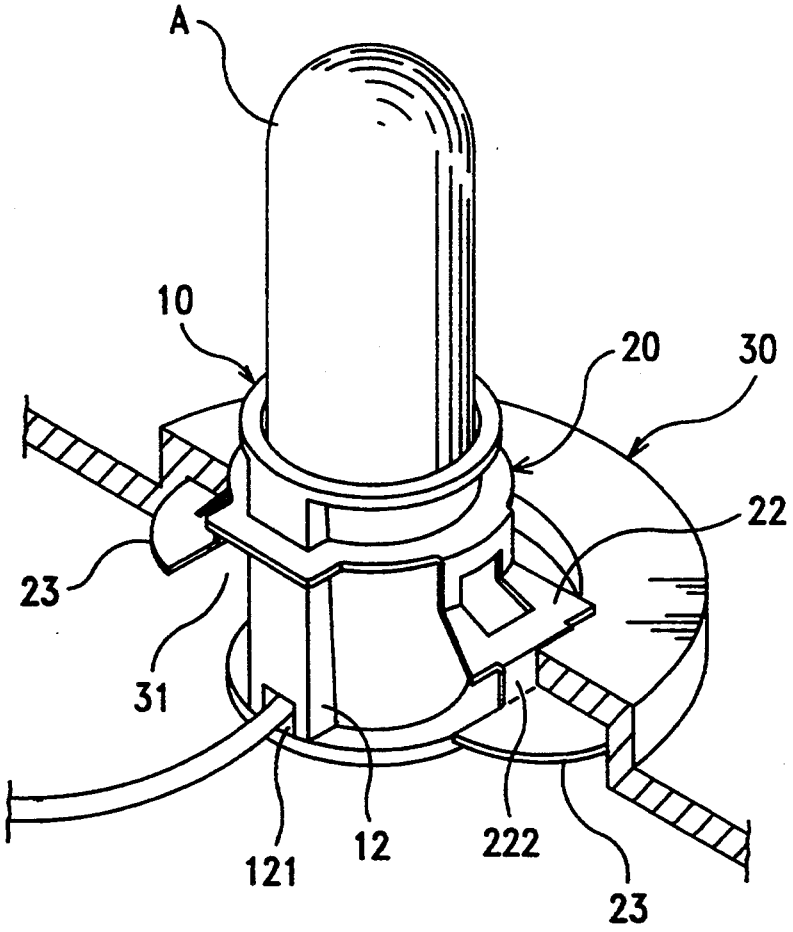
FIG. 5 is a cutaway view showing the lamp socket mounting device mounted on the socket holder.

Referring to FIGS. 4, 4A and 5, the half-round bottom stop frame portions 23 can be deformed to shorten the diameter and then inserted into the socket mounting hole 31 on the socket holder 30 of a lighting fixture. Once the half-round bottom stop frame portions 23 were respectively inserted into the socket mounting hole 31, they automatically return to the respective shape and stopped within the socket holder 30. The diameter of the half-round bottom stop frame portions 23 is relatively longer than the diameter of the socket mounting hole 31, therefore the half-round bottom stop frame portions 23 will not escape out of the socket holder 30 after the insertion. When the lamp socket 10 is installed in the socket mounting hole 31 on the socket holder 30 of a lighting fixture to hold a lamp bulb A, the clamping edges 221 of the upper stop frame portions 22 of the butterfly clamping plate 20 are respectively and bilaterally stopped at the top surface of the socket holder 30, the neck portions 222 of the butterfly clamping plate 20 are bilaterally stopped against the periphery of the socket mounting hole 31, and the half-round bottom stop frame portions 23 are bilaterally clamped on the bottom surface of the socket holder 30. Therefore, the lamp socket 10 is firmly retained in the socket mounting hole 31 of the socket holder 30. Furthermore, the length of the clamping edge 221 of either upper stop frame portion 22 is longer than the diameter of the socket mounting hole 31 on the socket holder 30, therefore the butterfly clamping plate 20 will not drop inside the socket holder 30 during the mounting procedure.

What is claimed is:

1. A lamp socket mounting device comprising a lamp socket installed in a socket mounting hole on a socket holder, and a butterfly clamping plate mounted around said lamp socket and fastened to said socket holder to hold down said lamp socket in position, wherein said lamp socket is made of cylindrical shape gradually smaller toward the bottom, having a trapezoidal block raised from an outside wall thereof and extended from a top frame thereof to a bottom edge thereof; said butterfly clamping plate comprises a loop-like base frame portion mounted around said lamp socket, two curved, symmetrical upper stop frame portions bilaterally extended downwards from said loop-like base frame portion, two half-round bottom stop frame portions inserted into said socket mounting hole and stopped against said socket holder at the bottom, and two neck portions respectively connected between said upper stop frame portions and said bottom stop frame portions and stopped against the periphery of said socket mounting hole, said upper stop frame portions having a respective bottom end terminated to a respective clamping edge stopped against said socket holder at the top, said loop-like base frame portion comprising a rectangular portion fitted over said trapezoidal block of said lamp socket.

* * * * *